US005083950A

United States Patent [19]

Suhrbier

[11] Patent Number: 5,083,950

[45] Date of Patent: Jan. 28, 1992

[54] APPARATUS FOR REDUCING CAVITATION EROSION

[75] Inventor: Klaus R. Suhrbier, Emsworth, England

[73] Assignee: Vosper Thornycroft (UK) Limited, Southampton, Great Britain

[21] Appl. No.: 454,316

[22] Filed: Dec. 21, 1989

[30] Foreign Application Priority Data

Dec. 22, 1988 [GB] United Kingdom ..... 8829905

[51] Int. Cl.[5] ..... B63H 21/32

[52] U.S. Cl. ..... 440/66; 440/82

[58] Field of Search ..... 440/49, 89, 66, 82, 440/52, 47; 416/93 A, 93 M, 244 B

[56] References Cited

U.S. PATENT DOCUMENTS

| | | | |
|---|---|---|---|
| 3,434,447 | 3/1969 | Christensen et al. | 440/89 X |
| 3,745,964 | 7/1973 | Henrich | 115/34 R |
| 3,788,267 | 1/1974 | Strong | 115/17 |
| 3,919,965 | 11/1975 | Ross | 440/89 X |
| 3,924,556 | 12/1975 | Wacker | 115/35 |
| 4,135,469 | 1/1979 | Rimppi et al. | 114/270 |
| 4,931,026 | 6/1990 | Woodland | 440/89 X |

FOREIGN PATENT DOCUMENTS

| | | |
|---|---|---|
| 0077931 | 5/1983 | European Pat. Off. . |
| 650590 | 3/1935 | Fed. Rep. of Germany . |
| 2403478 | 4/1979 | France . |
| 740117 | 8/1974 | Norway . |
| 132423 | 8/1975 | Norway . |
| 2067709 | 7/1981 | United Kingdom . |
| 8200812 | 3/1982 | World Int. Prop. O. . |

OTHER PUBLICATIONS

"Cavitation Erosion Prevention by Air Injection" by E. Huse, *Proceedings, Fourth Ship Technology and Re-*

(List continued on next page.)

*Primary Examiner*—Ed Swinehart

*Attorney, Agent, or Firm*—Gottlieb, Rackman & Reisman

[57] ABSTRACT

Apparatus for reducing cavitation erosion is disclosed which includes ducts and openings (30, 32, 34, 40) for discharging a stream of gas positioned upstream of and adjacent to a propeller (11), in a direction perpendicular to the oncoming flow and at a lateral position relative to the propeller rotation axis.

14 Claims, 3 Drawing Sheets

OTHER PUBLICATIONS

*search (STAR) Symposium,* Society of Naval Architects and Marine Engineers, 1979, pages 77 et seq.

"Propeller Induced Excitation Forces and Vibrations, Cavitation Noise and Erosion" by E. Huse, *Proceedings, International Symposium on Advances in Marine Technology,* 1979, Volume 1, pages 183 et seq.

"Cavitation Inception and How It Scales; A Review of the Problem With a Summary of Recent Research" by R. E. A. Arndt, *Symposium on High Powered Propulsion of Large Ships, Part 2,* 1974, pages XXI, 1 et seq.

"Cavitation" by I. S. Pearsall, *M&B Monograph ME/10,* page 23.

"Cavitation" by I. S. Pearsall and E. A. Spencer, *Science Journal,* May 1966, page 2 et seq.

"Studies of Propeller Cavitation Erosion" by H. Lindgren and E. Bjärne, *Conference of the Fluid Machinery Group of the Institute of Mechanical Engineers,* 1974, pages 241 et seq.

"Kavitationsverhalten und instationare 'Belastung von Schiffspropellern by Schräganströmung" by J. Blaurock, *Jahrbuch der Schiffbautechnischen Gesellschaft,* Volume 71, 1977, pages 163 et seq.

"Subcavitating Propeller Design for High Powered Small Craft" by J. F. Paulsen, J. P. van Doorn and H. P. Fransen, *International Conference on Propulsion for Small Craft. Propellers, Sterngear Engines and Installations,* 1983, pages 5/1 et seq.

"Controllable Pitch Propellers for Naval Vessels" by F. Schanz-Escher Wyss, *Europort 78,* pages 135 et seq.

"Investigations on the Ducted Propeller Cavitation and the Duct Erosion Prevention of the Air Injection System" by H. Narita et al.

"Some Experiments on Cavitation Erosion in Water Mixed With Air" by R. E. H. Rassmussen.

APPARATUS FOR REDUCING CAVITATION EROSION

This invention relates to apparatus for reducing cavitation erosion.

The undesirable effect of cavitation erosion upon propeller blades has long been recognised. Proposals have been made for limiting the damage which such erosion can cause. One such proposal is to reduce the effect of cavitation by injecting air into the water flow over the propeller, for example as disclosed in GB 2 067 709B.

It is an object of the invention to provide an improved apparatus for reducing root and hub erosion of propeller blades.

According to the invention in a first aspect there is provided apparatus for reducing cavitation erosion comprising means for discharging a stream of gas, into the liquid supporting the boat, upstream of and adjacent to the propeller, with the gas stream being directed transversely to the oncoming flow of liquid over the propeller, and with the discharge location being arranged at an angle position about the axis of rotation of the propeller which is within a predetermined range of angle positions of each given propeller blade passing the discharge location, such that a substantial proportion of the gas is entrained into the flow over the propeller at a range of blade angle positions at which blade root erosion occurs.

Preferably the discharge position is greater than 60° and less than 180° from the uppermost blade position, in the direction of rotation of the propeller.

According to the invention in a second aspect, there is provided apparatus for reducing cavitation erosion comprising means for discharging a stream of gas from a position upstream of and adjacent to a propeller and in a direction substantially normal to the oncoming flow direction.

According to the invention in a third aspect, there is provided apparatus for reducing cavitation erosion comprising means for discharging a stream of gas, from a position upstream of and adjacent to a propeller, in a direction transverse to the direction of flow of the liquid over the propeller, the discharging means comprising a passage formed in a support for a shaft for a said propeller and the passage having an opening formed in a side wall of the support over which side wall water flows towards the propeller.

An embodiment of the invention will now be described, by way of example, with reference to the accompanying drawings, in which:

DESCRIPTION OF THE PREFERRED EMBODIMENTS

Figure 1:
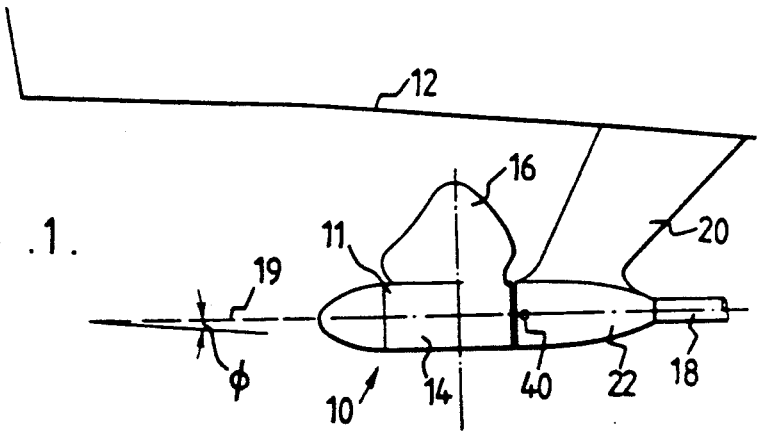
FIG. 1 is a side view of a propeller assembly.
Figure 2:
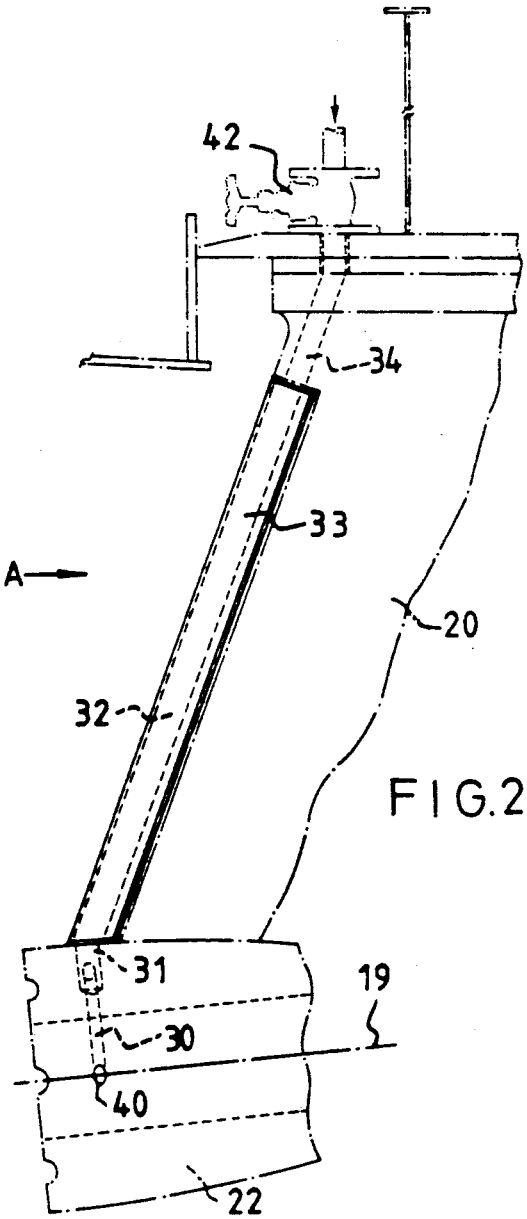
FIG. 2 is a fragmentary side elevational view of the propeller shaft bracket of FIG. 1 and illustrates an arrangement utilizing, according to one embodiment of the invention, a partly external and partly internal passage for the gas through the shaft bracket.
Figure 3:
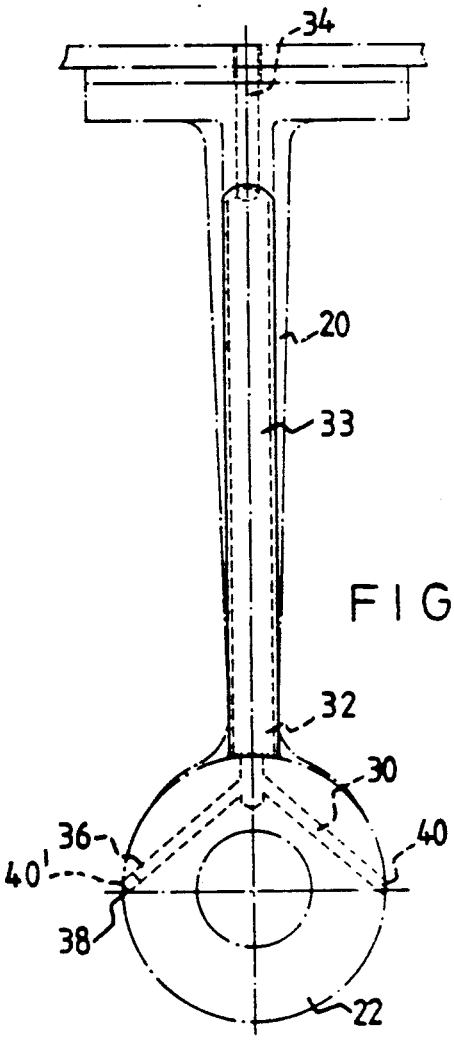
FIG. 3 is a rear elevational view of the structure shown in FIG. 2, the view being taken in the direction of the arrow A of FIG. 2.

With reference to FIGS. 1, 2 and 3, a propeller assembly is shown, generally designated 10, connected to the underside of a hull 12 of a water borne vessel adjacent the stern. The propeller assembly 10 comprises a propeller 11 having a propeller hub 14 upon which a plurality of propeller blades, for example, five propeller blades, are connected at the respective blade roots, of which only one blade, labelled 16, is shown. The propeller hub 14 is connected via a propeller shaft 18, to a prime mover and gearbox (not shown) for rotation of the propeller 11 about propeller axis 19. The propeller axis 19 is inclined by an angle $\phi$ to the flow or to the adjacent hull contour 12, $\phi$ being in the range of 5° to 20°.

The propeller shaft 18 is supported adjacent to the propeller by a shaft support, which comprises a shaft bracket 20 connected to a shaft bracket barrel 22 in which the shaft 18 is journalled.

The shaft bracket and shaft bracket barrel include means for introducing a stream of gas into the water flow over the propeller, as is more clearly shown in FIGS. 2 and 3. Air, or another gas or gas mixture, for example exhaust gas, may be used for this purpose. The gas introducing means comprises a bore 30 drilled through the barrel 22 which terminates at one end in a discharge opening 40 and which at its other end connects via a passage 31 with a channel or passage 32 machined out of the shaft bracket 20 at its exterior, which channel, in turn, communicates with a further internal drilled duct or passage 34 connected, via a shut off valve 42, to a gas supply (not shown in FIG. 2). The channel 32 is covered with a wrapped plate 33 which is welded in place.

The bore 30 is disposed so that it faces to starboard for a right-handed propeller and to port for a left-handed propeller. A separate shaft bracket may be used for each propeller, either right-hand or left-hand, with the bore 30 so disposed as before. Alternatively, in order to allow a single shaft bracket to be used for both right and left-hand propellers, a further bore 36 preferably symmetrical with the bore 30 and also branching off the passage 31 and terminating in a respective discharge opening 40' (see FIG. 3), is drilled in the shaft bracket. In use, one bore 30 or 36 is blocked off with a steel plug 38 welded in place. The shaft bracket shown in FIG. 3 is arranged for use with a right-handed propeller, the bore 36 being blocked off by the steel plug 38, and the reverse would be done in the case of a left-handed propeller.

The bore 30 is arranged to discharge gas into the water flow around the shaft barrel 22 from a position and in a direction to enhance the gas/water mix and distribution and enable gas to be injected into the flow adjacent the most critical blade angle position, so as to enter and mix with any cavities, for reduction of erosion.

Figure 5:
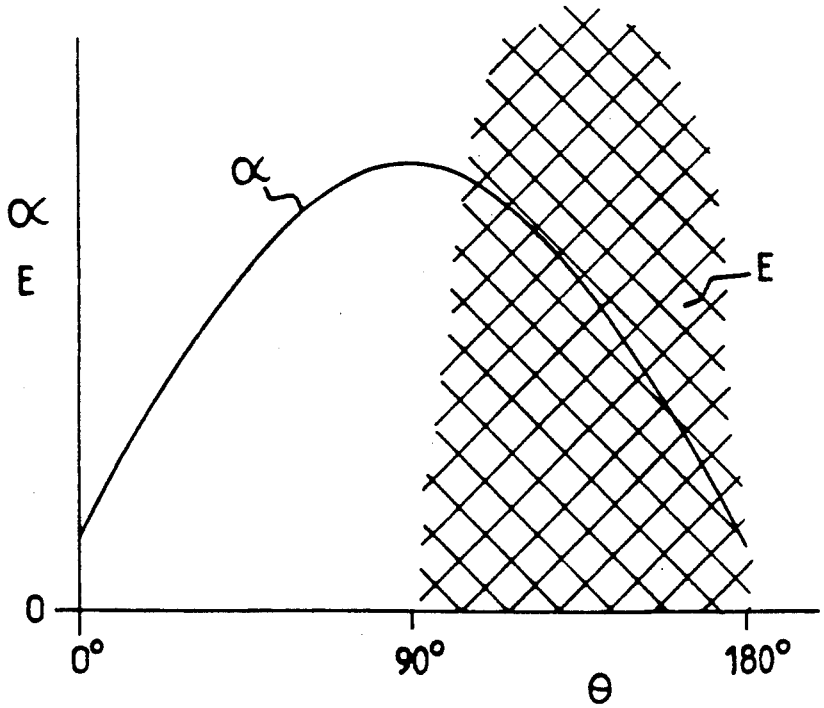
FIG. 5 is a graph illustrating the variation of propeller blade angle of attack and blade root erosion with rotation angle.

With reference to FIG. 5, this shows a graph illustrating the angle of attack $\alpha$ of a propeller blade against angular position, from the uppermost angular position of the propeller blade reference line ($\theta=0°$) to the lowermost position ($\theta = 180°$), in the direction of rotation of the propeller. It can be seen that the angle of attack $\alpha$ peaks at the midway (90°) position, and it has been found that this position marks approximately the earliest point at which the onset of blade root erosion occurs (illustrated by area E). Root and hub erosion can occur throughout the 90°-180° quadrant but dies away after 180° due to subsequent reduction in angle of attack. Thus, injection of gas into the flow, to minimise the cavitation damage, must be such that gas is entrained into the flow in the 90°-½° region. A slight lead angle for entrainment can be advantageous and gas injection in the angle range of $60° < \theta < 180°$, more preferably in the angle range of $80° < \theta < 150°$, has been found to be effective, the most preferable position being 90° as shown in the drawings.

It has been found that air or gas bubbles can displace displaced by the vapour filled cavities (formed in the low pressure regions) on the propeller blades. In order to improve the mixing process, the gas is introduced into the localised flow at opening 40 in contact with the shaft bracket barrel side wall. This allows the gas to remain in contact with the surface of the bracket barrel and thus to follow the flow on to the propeller boss and to mix with or enter into the cavities on the blade root and hub surface more easily.

The gas is also directed by bore 30 into the flow in a direction substantially normal to the oncoming flow over the surface of barrel 22. This has been found to improve the gas flow distribution.

Figure 4:
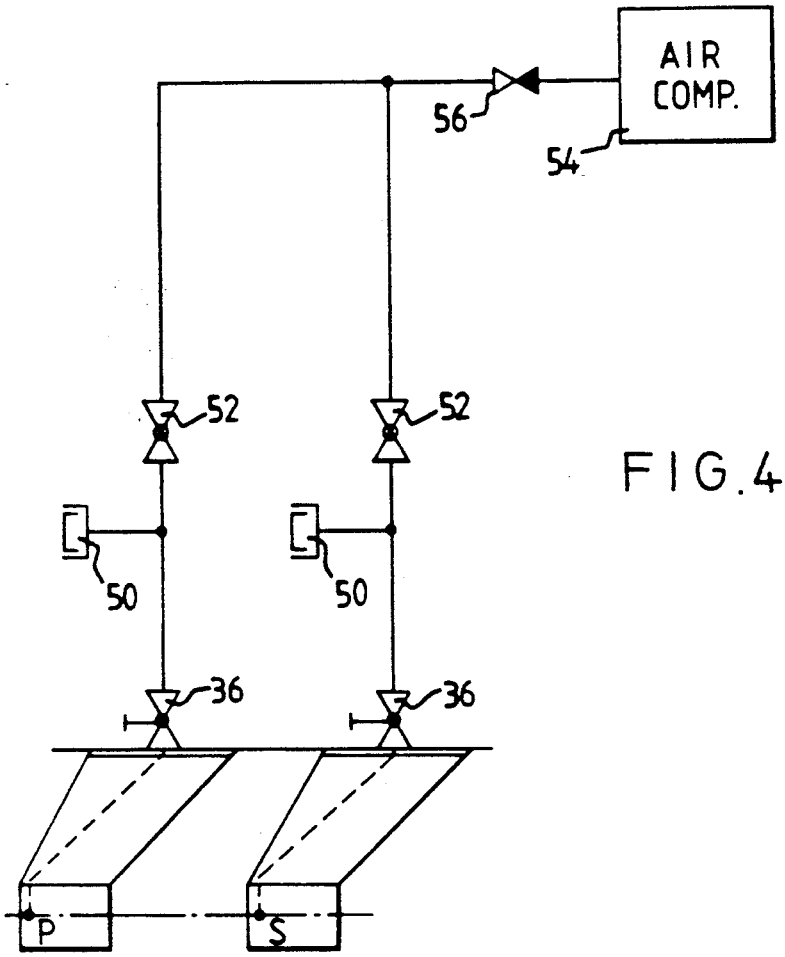
FIG. 4 is a schematic drawing showing the propeller air supply system.

FIG. 4 illustrates a propeller air supply system for a two propeller vessel. The propellers are disposed about the longitudinal centre line of the vessel (the propeller supports being labelled port (P) and starboard (S)). The air supply system is connected via shut off valves 36, bleed valves 50 and control valves 52, to an air compressor, 54, via a throttle 56.

The actual air flow rate which is required for each propeller depends upon numerous factors, for example, shaft angle, ship and shaft speed, type or shape of blade section and the number of blades. The air flow rate may be determined, for example, for a given selection of the factors mentioned above, by calculation, estimation, scale model tests or in actual use, as would be apparent to those skilled in the art.

Figure 2A:
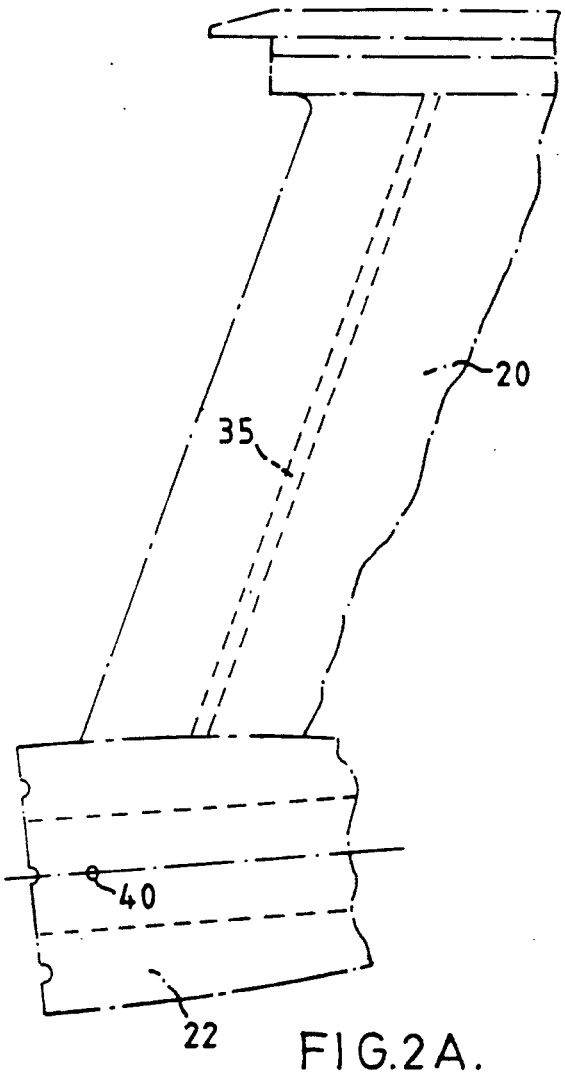
FIGS. 2A and 2B are views similar to FIG. 2 and illustrate, respectively, arrangements utilizing, according to other embodiments of the invention, an entirely internal and an entirely external gas passage through the shaft bracket.
Figure 2B:
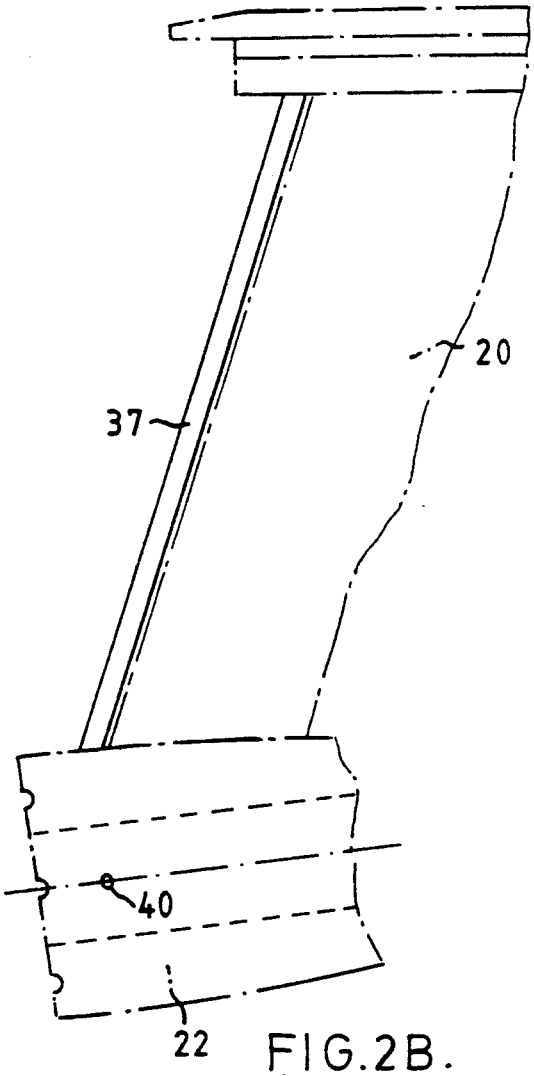

Although the discharging means has been described primarily as a passage formed in the propeller shaft support partly externally and partly internally thereof, this is not to be construed as limitative and the passage may be otherwise constituted. For example, as shown in FIG. 2A, the partly external/partly internal combined passage 32/34 could be replaced by a single passage 35 located entirely internally of the shaft bracket 20 and communicating at its upper and lower ends with the passages (not shown) in the boat leading to the gas supply and in the shaft bracket barrel 22 leading to the opening 40 or to the openings 40 and 40', or, as shown in FIG. 2B, the partly external/partly internal combined passage 32/34 could be replaced by a pipe 37 located entirely externally of the shaft bracket 20 and communicating at its upper and lower ends with the passages (not shown) in the boat leading to the gas supply and in the shaft bracket barrel 22 leading to the opening 40 or the openings 40 and 40'.

The discharge may also be aft of the shaft barrel, in front of the propeller.

While only a single hole or discharge opening located in a position at 90° from the uppermost propeller blade position (see FIG. 1) has been shown, a plurality of such holes or discharge openings located at angle positions in the range of 60° to 180° from the uppermost propeller blade position may be used.

I claim:

1. An arrangement for reducing root cavitation erosion of the blades of a propeller of a boat in a body of liquid, the propeller being connected to the boat by means of a support, the propeller having a propeller hub and being arranged for rotation about an axis of rotation oriented at an angle to the hull of the boat within the liquid flowing over the propeller when the same is in operation, and each propeller blade having a root area by which the blade is connected to said propeller hub; the arrangement comprising:

means for discharging a stream of gas, into the liquid supporting the boat, at a location upstream of and adjacent to the blade root area of each propeller blade as the same passes said location during rotation of the propeller, with said discharging means being arranged stationary in said support to direct the stream of gas in a direction transverse to the oncoming flow of liquid, and with said discharge location being arranged at an angular position about said axis of rotation of the propeller which is within a predetermined range of angle positions separated from the uppermost position of each given propeller blade during its rotational movement, such that at least some of the gas is entrained into the liquid flow over said propeller and mixes with and enters any cavities in the blade root area of each given propeller blade passing the discharge location at an angle position within said range of angle positions of that propeller blade.

2. An arrangement as claimed in claim 1, wherein said discharging means comprises a passage which is formed in one part of said support adjacent said propeller hub and terminates at its discharge end region in a discharge opening, and said discharge opening is arranged at said discharge location.

3. An arrangement as claimed in claim 1, wherein said discharging means comprises a passage which is formed in a part of said support adjacent said propeller hub and at its discharge end region branches into two bores terminating in respective discharge openings located at respective discharge locations on opposite sides of said axis of rotation of the propeller, and wherein for any given propeller designed for rotation in one direction or the other, an appropriate one of said bores is sealed and the other of said bores is open so that said stream of gas is discharged only through said other bore via the respective discharge opening thereof.

4. An arrangement as claimed in claim 1, wherein said discharging means comprises a pipe arranged externally to said support.

5. An arrangement as claimed in claim 2, wherein said discharging means comprises a pipe in conjunction with said passage in said one part of said support, said pipe being arranged externally to said support and communicating with said passage.

6. An arrangement as claimed in claim 2, wherein said discharging means comprises a further passage in conjunction with the first-mentioned passage in said one part of said support, said further passage being formed internally of another part of said support and communicating with said first-mentioned passage.

7. An arrangement as claimed in claim 2, wherein said discharging means comprises a further passage in conjunction with the first-mentioned passage in said one part of said support, said further passage being formed partly externally and partly internally of another part of said support and communicating with said first-mentioned passage.

8. An arrangement as claimed in claim 1, wherein said discharging means is arranged to discharge said stream of gas at at least one angular position ($\theta$) relative to the uppermost blade position in the direction of rotation of the propeller, and said at least one angular position ($\theta$) is in the range of $60° < \theta < \approx 180°$ from said uppermost blade position.

9. An arrangement as claimed in claim 1, wherein said discharging means is arranged to discharge said stream of gas at at least one angular position ($\theta$) relative to the uppermost blade position in the direction of rotation of the propeller, and said at least one angular position ($\theta$) is in the range of $80° < \theta < 150°$ from said uppermost blade position.

10. An arrangement as claimed in claim 1, wherein said discharging means is arranged to discharge said stream of gas at at least one angular position ($\theta$) relative to the uppermost blade position in the direction of rotation of the propeller, and said at least one angular position ($\theta$) is substantially 90° from said uppermost blade position.

11. An arrangement as claimed in claim 1, wherein said discharging means is arranged to direct the stream of gas in a direction substantially normal to the oncoming liquid flow.

12. An arrangement as claimed in claim 1, wherein said discharging means is arranged to discharge the stream of gas in a starboard direction for a right-handed propeller or in a port direction for a left-handed propeller.

13. An arrangement as claimed in claim 1, further comprising gas supply means for supplying gas to said discharging means.

14. An arrangement as claimed in claim 13, wherein said gas supply means comprises an air compressor.

* * * * *